United States Patent [19]

Scheerer et al.

[11] 4,348,474

[45] Sep. 7, 1982

[54] LIGHT SENSITIVE PHOTOGRAPHIC RECORDING MATERIAL AND THE USE THEREOF FOR THE PRODUCTION OF PHOTOGRAPHIC IMAGES

[75] Inventors: Rainer Scheerer, Cologne; Erwin Ranz, Leverkusen; Joachim W. Lohmann, Odenthal, all of Fed. Rep. of Germany

[73] Assignee: Agfa-Gevaert Aktiengesellschaft, Leverkusen, Fed. Rep. of Germany

[21] Appl. No.: 286,261

[22] Filed: Jul. 23, 1981

[30] Foreign Application Priority Data

Aug. 1, 1980 [DE] Fed. Rep. of Germany ..... 3029209

[51] Int. Cl.[3] ..... G03C 1/76

[52] U.S. Cl. ..... 430/382; 430/505; 430/506; 430/509; 430/544; 430/549

[58] Field of Search ..... 430/382, 505, 506, 509, 430/544, 549

[56] References Cited

U.S. PATENT DOCUMENTS

| | | | |
|---|---|---|---|
| 3,620,746 | 11/1971 | Barr | 430/509 |
| 3,620,747 | 11/1971 | Marchant et al. | 430/509 |
| 3,695,882 | 10/1972 | Kumai | 96/68 |
| 3,703,375 | 11/1972 | Groet et al. | 430/546 |
| 3,726,681 | 4/1973 | Pankow et al. | 430/509 |
| 3,811,890 | 5/1974 | Ohta et al. | 430/509 |
| 3,932,185 | 1/1976 | Matsuura | 430/545 |
| 4,170,479 | 10/1979 | Usami | 96/68 |

OTHER PUBLICATIONS

Patents abstracts of Japan, vol. 3, No. 77, Jun. 30, 1979, p. 40, E 120.

*Primary Examiner*—J. Travis Brown
*Attorney, Agent, or Firm*—Connolly and Hutz

[57] ABSTRACT

A photographic recording material having at least 2 panchromatically sensitized silver-halide emulsion layers differing in speed, a DIR-compound and at least 2 yellow couplers of differing coupling velocity provides an improved graininess.

9 Claims, No Drawings

LIGHT SENSITIVE PHOTOGRAPHIC RECORDING MATERIAL AND THE USE THEREOF FOR THE PRODUCTION OF PHOTOGRAPHIC IMAGES

This invention relates to a photographic recording material having increased speed, improved graininess and improved response to over-exposure.

It is known that, other things being equal, the speed of a photographic silver halide emulsion to light increases with the size of the silver halide grains. The speed to light obtainable in films is therefore limited by the coarseness of the grain. This applies equally to so-called black-and-white films and to colour films which are developed chromogenically since the graininess of the colour grain depends inter alia on the graininess of the silver halide in the emulsion. It has been disclosed in German Offenlegungsschrift No. 1,422,839 (U.S. Pat. Nos. 3,227,551 and 3,227,554) to reduce the graininess of the silver image by using development inhibiting mercaptans. Light-sensitive photographic materials containing a hydroquinone derivative capable of releasing a development inhibitor have been disclosed in German Offenlegungsschrift No. 2,443,738 and U.S. Pat. No. 3,961,963. These materials may be conventional black-and-white materials. In German Offenlegungsschrift No. 2,540,959 and U.S. Pat. No. 4,052,213 it has been disclosed to improve the graininess and sharpness by using so-called DIR compounds in conventional black-and-white materials, as well as in developer solutions used for the development of colour photographic materials, as well as black-and-white materials.

In German Offenlegungsschrift No. 1,522,376 and British Pat. No. 1,145,753, it has been disclosed to increase the speed of photographic materials without increasing the grain size by applying a faster second emulsion having a coarser grain on top of a fine grained emulsion of medium speed German Offenlegungsschrift No. 2,600,524 discloses colour photographic recording materials containing a silver halide emulsion layer comprising at least two individual layers which are sensitive in the same spectral region, one of which has a relatively high speed and contains a high speed coupler, as well as a slow coupler, while the other individual layer is relatively slow and contains a slow coupler. The material may in addition contain a DIR coupler and is said to have greater speed and improved graininess.

In German Offenlegungsschrift No. 2,650,764 there is disclosed a process for the production of colour photographic images in which the exposed photographic recording material is developed in the presence of certain polyfunctional couplers and certain polyfunctional developer compounds to form dyes having a neutral black tone. In German Offe nlegungsschrift No. 2,038,199 and U.S. Pat. No. 3,695,882 there is disclosed a photographic black-and-white material in which at least two silver halide emulsions are applied to a support, the emulsions containing one or more colour couplers and both silver halide emulsions being spectrally sensitized to virtually the same spectral range.

From the state of the art indicated, chromogenic development of photographic materials in the presence of couplers for the purpose of black-and-white photography is known, but it has not hitherto been possible to achieve a substantial improvement in the photographic properties of the materials compared with those of conventional black-and-white materials which do not contain couplers, particularly with respect to the graininess, speed and sharpness.

It is an object of the present invention to provide an improved photographic material. This material should in particular ensure improved graininess and allow wider latitude in the exposure conditions.

A photographic recording material has been found which has at least two panchromatically sensitised silver halide emulsion layers differing in the speed thereof, the faster of the two silver halide emulsion layers being situated further away from the support than the slower speed layer, and each of these two layers containing at least two colour couplers, at least one of which gives rise to a yellow dye in chromogenic development, characterised in that at least one layer contains a compound which splits off a development inhibitor, and in that the faster silver halide emulsion layer contains a yellow coupler in a relatively rapidly coupling form, while the slower layer contains a yellow coupler in a relatively slowly coupling form.

The material according to the present invention preferably has two silver halide emulsion layers which are both panchromatically sensitised and which contain magenta and cyan couplers in addition to the yellow couplers. When this material is chromogenically developed after imagewise exposure, a black and white image is generally obtained. In a preferred embodiment, the rapidly coupling yellow coupler in the faster layer is a hydrophillic coupler dissolved in an alkaline solvent. The slower layer preferably contains a hydrophobic, emulsified yellow coupler. It is possible that all yellow couplers are emulsified. Especially in this embodiment a yellow coupler in relatively slowly coupling form may be present in the faster silver halide emulsion layer and a yellow coupler in relatively rapidly coupling form in the slower layer. In such a case the molar ratio of the rapidly coupling coupler to the slowly coupling coupler is generally between 10 and 0,8 in the faster layer and between 0,2 and 1,3 in the slower layer. The cyan and magenta couplers in the faster layer are preferably slowly coupling couplers, in particularly hydrophobic, emulsified couplers.

The compound from which a development inhibitor is split off may be in particular a DIR compound, which is preferably contained in at least two silver halide emulsion layers.

It has been found that the materials according to the present invention are particularly suitable for the production of photographic images by imagewise exposure and development. The conventional colour developer substances are suitable for development. It is suprisingly found that exceptionally fine grained images having true tone values are obtained after exposure and development of the materials according to the present invention, even if the materials have been overexposed.

The materials according to the present invention are suitable in particular as recording materials for the production of negatives from which copies may be prepared in known manner. The copies may be produced on conventional black-and-white materials which are free from colour couplers or they may be produced on the materials according to the present invention. Due to the exceptionally fine grain and true rendering of tones combined with maximum speed of the photographic materials according to the present invention, exceptionally fine grained copies having faithful tone reproduction may be obtained. While in conventional materials the graininess increases with the density, the graininess of the materials according to the present invention decreases as the colour density increases.

The halides contained in the silver halide emulsions used may be chlorides, bromides, or iodides or mixtures thereof. Bromide emulsions and iodobromide emulsions are preferred. The faster of the two silver halide emulsions is preferably a silver iodobromide emulsion containing more than 5% of iodide, while the slower emulsion is preferably a silver iodobromide containing less than 5 mol % of iodide. The ratio of speed of the faster to the slower silver halide emulsion is preferably from 1:3 to 1:20, in particular from 1:5 to 1:10.

The colour couplers used may in principle be any type of non-diffusible compounds from which image dyes may be produced by suitable treatment (development). It is preferred to use conventional non-diffusible colour couplers which react with the colour developer oxidation products in known manner to form a non-diffusible dye. The colour coupler used for producing the yellow partial image is generally a compound containing an open chain keto methylene group, while the coupler for producing a cyan partial image is generally a compound of the phenol or α-naphthol series and that for producing the magenta partial image is normally a colour coupler of the 5-pyrazolone or indazolone series. Colour couplers of these types are known in large numbers and have been described in numerous patent specifications, as well as on other publications; for example, in "Farbkuppler" by W. Pelz in "Mitteilungen aus den Forschungslaboratorien der Agfa, Leverkusen/Munchen", Volume III, page 111 (1961) and the publication by K. Venkataraman in "The Chemistry of Synthetic Dyes", Vol. 4, pages 341 to 387, Academic Press (1971).

The colour couplers used may be either conventional 4-equivalent couplers or 2-equivalent couplers which require a smaller quantity of silver halide for colour production. As is known, 2-equivalent couplers are derived from 4-equivalent couplers in that they contain in the coupling position a substituent which is split off in the coupling reaction.

The rapid yellow couplers and slow colour couplers used according to the present invention differ in the relative coupling velocity thereof, which may be determined by known methods (see e.g., "Mitteilungen aus den Forschungslaboratorien der Agfa Leverkusen/-Munchen", Volume III, page 81 and German Offenlegungsschrift No. 2,853,362, pages 12 to 16). The coupling velocity of the high speed yellow coupler is preferably from 3 to 50 times, most preferably from 4 to 12 times, greater than that of the slow coupler. It should be noted that the reactivity of couplers depends not only on the structure of the coupler, but also on the method employed for introducing it into the photographic material. The reactivity of a coupler is generally lower when the coupler is introduced in the form of a dispersion than when it is introduced in the form of an aqueous alkaline solution. Couplers having a relatively high coupling velocity and those having a relatively low coupling velocity have been disclosed, for example, in German Offenlegungsschrift No. 1,958,709, pages 6 to 11 and in German Offenlegungsschrift No. 2,600,524, pages 8 to 21. The quantity of yellow coupler used is preferably from 0.03 to 0.5 mol per mol of silver halide. Magenta couplers and cyan couplers are preferably used in quantities which result in a neutral grey image after imagewise exposure and development.

According to the present invention, the photographic materials also contain compounds which react with colour developer oxidation products to release a substance which inhibits development of the silver halide. These compounds may be present in only one panchromatically sensitised layer or in two or more such layers.

Numerous compounds of this type are known. Examples include the known DIR couplers (DIR=development inhibitor releasing), which are colour couplers containing a releaseable inhibitor group in the coupling position. Such DIR couplers have been described in, for example U.S. Pat. No. 3,227,554. Another group of compounds which release development inhibiting substances when reacted with colour developer oxidation products has been described in U.S. Pat. No. 3,632,345. These compounds are not colour couplers and consequently no dyes are formed when the development inhibiting substances are released. This group of compounds is also known as DIR couplers which couple without colour formation, or as DIR compounds, to distinguish them from dye forming DIR couplers.

Such compounds have been described not only in U.S. Pat. No. 3,632,345 mentioned above, but also, for example, in German Offenlegungsschrift Nos. 2,362,752; 2,359,295; 2,405,442; 2,448,063; 2,529,350; 2,540,959 and 2,552,505. DIR couplers have also been mentioned in German Offenlegungsschrift Nos: 2,729,213; 2,709,688; 2,707,483; 2,540,959; 2,617,310 and 2,552,505. Among these compounds, it is preferred to use those which release a mercapto compound as inhibitor.

The quantity of DIR coupler or DIR compound used is preferably from 2 to 20 mg per g of $AgNO_3$ in the silver halide emulsion.

The effective reaction velocity constants in the faster silver halide emulsion layer as determined according to German Offenlegungsschrift No. 2,853,362 are preferably above 50,000 for the yellow coupler and from 2000 to 10,000 for the magenta and cyan couplers. The reaction velocity constant of the yellow coupler in the slower layer is preferably from 2000 to 10,000. In a preferred embodiment, the reaction velocity constants of the magenta and the cyan coupler of the slower layer are above 1,000. The reaction velocity constant of the DIR couplers used as preferably from 3000 to 50,000 (the dimension of these reaction velocity constants is $1 \times mol^{-1} \times sec^{-1}$). If all yellow couplers are emulsified the reaction velocity constant of the rapid coupler is generally above 5,000 and the reaction velocity constant of the slow coupler generally below 3,000.

The binder used in the photographic layers is preferably gelatine, although this may be partly or completely replaced by other natural or synthetic binders.

The emulsions may also be chemically sensitised, e.g. by the addition of sulphur compounds, such as allyl isothiocyanate, allyl thiourea or sodium thiosulphate, at the stage of chemical ripening. Reducing agents may also be used as chemical sensitisers, e.g. the tin compounds described in Belgian Pat. Nos. 493,464 and 568,687, polyamines, such as diethylenetriamine and aminomethylsulphinic acid derivatives, e.g. according to Belgian Pat. No. 547,323. Noble metals, such as gold, platinum, palladium, iridium, ruthenium or rhodium, and compounds of such metals are also suitable chemical sensitisers. The emulsions may also be sensitised using polyalkylene oxide derivatives, e.g. using a polyethylene oxide having a molecular weight of from 1000 to 20,000, or using condensation products of alkylene oxides and alcohols, aliphatic carboxylic acids, aliphatic amines, aliphatic diamines and amides.

The emulsions are panchromatically sensitised, e.g. using the conventional polymethine dyes, such as neutrocyanines, basic or acid carbocyanines and dicarbocyanines, rhodacyanines and the like. Sensitisers of this type have been described in the work by F. M. Hamer "The Cyanine Dyes and related Compounds", (1964). Particular reference may be made in this connection to Ullmanns Enzyklopädie der technishcen Chemie, 4th Edition, Volume 18, page 433.

Azaindenes are particularly suitable stabilisers, more especially the tetra- and penta-azaindenes and particularly those which are substituted by hydroxyl or amino groups. Compounds of this type have been described, e.g. in the article by Birr, Z.Wiss.Phot. 47 (1952), 2 to 58. Other suitable stabilizers include herterocyclic mercapto compounds, e.g. phenylmercaptotetrazole, quaternary benzothiazole derivatives and benzotriazole.

The layers of the photographic material may be hardened in the conventional manner, for example using formaldehyde, epoxide type hardeners, ethylene imine hardeners and acryloyl hardeners. The layers may also be hardened by the process according to German Offenlegungsschrift No. 2,218,009 to produce colour photographic materials suitable for high temperature processing. The photographic layers or colour photographic multilayered materials may also be hardened with hardeners of the diazine, triazine or 1,2-dihydroquinoline series.

The material according to the present invention may be developed using the conventional black-and-white developers, but is preferably subjected to colour development, in particular colour negative development. Reversal processing is also possible. In colour development, the couplers in the material generally react with the oxidation product of the colour developer substance used. Suitable colour developer substances include in particular those of the p-phenylene diamine series, e.g. N,N-dimethyl-p-phenylene diamine, 4-amino-3-methyl-N-ethyl-N-methoxyethylaniline, 2-amino-5-diethylamino-toluene, N-butyl-N-ω-sulphobutyl-p-phenylene diamine, 2-amino-5-(n-ethyl-N-β-methanesulphonamidoethylamino)-toluene, N-ethyl-N-β-hydroxyethyl-p-phenylenediamine, N,N-bis-(β-hydroxyethyl)-p-phenylene diamine and 2-amino-5-(N-ethyl-N-β-hydroxyethylamino)-toluene. Other suitable colour developers have been described, for example in J.Amer.-Chem.Soc. 73, 3100 (1951).

After colour development, the material is bleached and fixed in the conventional manner. Bleaching and fixing may be carried out separately or together.

The conventional bleaching agents may be used, e.g. ferricyanides, dichromates, water-soluble cobalt complexes, etc. Iron-III-complexes of aminopolycarboxylic acids are particularly preferred, e.g. of ethylene diaminotetracetic acid, nitrilotriacetic acid, iminodiacetic acid, N-hydroxyethylethylenediaminotriacetic acid, etc.

The materials according to the present invention are versatile in application. They are suitable for high speed camera films, as well as for reproduction photography for the production of colour separations. If the material according to the present invention is subjected to conventional colour negative treatment, the silver image may be completely removed at the bleaching stage since the image produced by the colour couplers remains. The silver may therefore be recycled to a large extent, in contrast to the silver used in conventional black-and-white materials. Furthermore, the material according to the present invention suprisingly combines two desirable, but opposing characteristics, namley the possibility to achieve maximum speed, as well as finest grain.

EXAMPLES

The compounds used in the following Examples have the following structure:

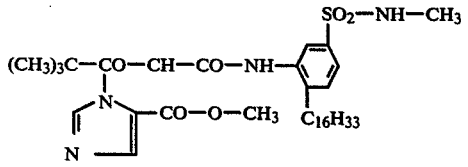

(1)

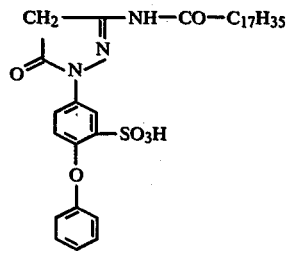

(2)

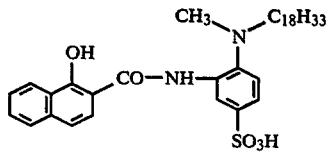

(3)

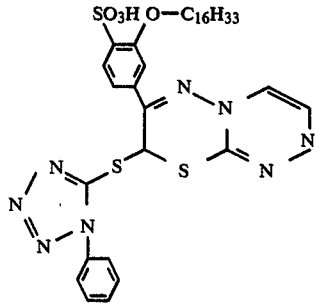

(4)

-continued

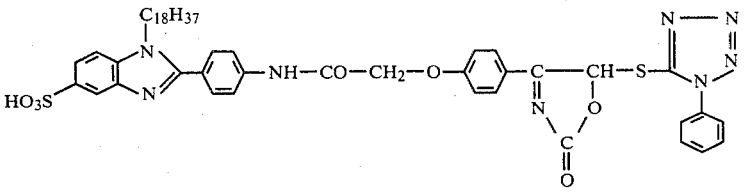

(5)

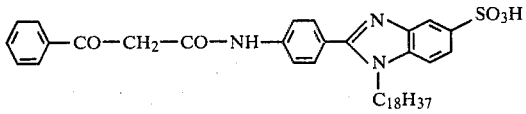

(6)

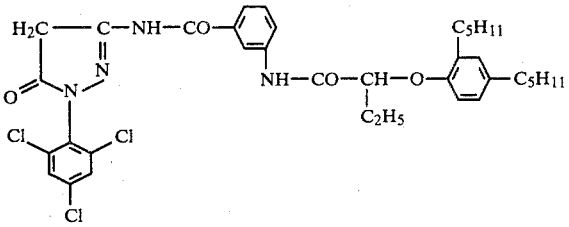

(7)

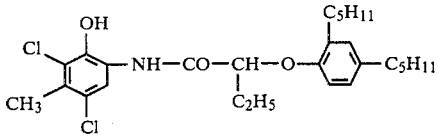

(8)

EXAMPLE 1

Material (A) according to the present invention 360 ml of a coupler emulsion which has been prepared by the following method are added to 2000 g of a panchromatically sensitised slower silver bromide emulsion of relatively low speed containing 4% iodide:

10 g of the yellow coupler of formula 1 and 10 g of tricresylphosphate are dissolved in 50 ml of ethyl acetate and dispersed in 100 ml of a 5% gelatine solution. The ethyl acetate is subsequently removed by evaporation.

200 ml of a 5% aqueous solution of the magenta coupler of formula 2 and 170 ml of an aqueous solution of the cyan coupler of formula 3 are then added. 60 ml of a 2% aqueous solution of the DIR compound of formula 4 and 30 ml of an aqueous solution of the DIR compound of formula 5 are thereafter added.

The emulsion having relatively low speed obtained by this method is cast on a transparent support. A second emulsion layer of relatively high speed, which has been prepared by the method given below, is then applied to the resulting layer:

200 ml of a 2% aqueous solution of the yellow coupler of formula 6 are added to 1000 g of a panchromatically sensitised faster silver bromide emulsion of relatively high speed containing 6% iodide. An emulsion of the magenta coupler of formula 7 which has been prepared by the same method as the emulsion of yellow coupler of formula 6 described above is then added in the quantity providing 10 g of the coupler. An emulsion of the cyan coupler of formula 8 is then added in analogous manner. 20 ml of a 1% aqueous solution of the DIR compound of formula 5 are added to the resulting emulsion.

COMPARISON EXAMPLE (B)

An emulsion of relatively low speed is prepared as described under (A), but with the following differences: Instead of using the soluble magenta coupler of formula 2, the hydrophobic magenta coupler of formula 7 is emulsified in the manner described for the yellow coupler of formula 1 and the emulsion is added in the quantity required to provide 30 g of the coupler. An emulsion of the cyan coupler of formula 8 is then added in analogous manner. The emulsion of relatively low speed obtained by this method is cast on a transparent support. A layer of high speed prepared by the following method is then cast on the resulting layer.

Coupler emulsions prepared by the method indicated under (A) are added in such quantities to 1000 g of a panchromatically sensitised faster silver bromide emulsion containing 6% iodide that 12 g of the yellow coupler of formula 1, 10 g of the magenta coupler of formula 7 and 10 g of the cyan coupler of formula 8 are present.

Material (A) according to the present invention and comparison material (B) are exposed imagewise and then colour developed by the process described as "c 41-Process" by P. Glafkides in "Chimie et Physique Photographiques", Paris 1976, page 748. The yellow separation of material (A) according to the present invention has a 60% higher speed than material (B), while the density curves for yellow, magenta and cyan are the same. The sharpness of the image is also improved in the material according to the present invention. While in material (B) the transfer of modulation at 27 lines/mm already drops to 50% of the value obtained at line/mm, this drop only occurs at 31 lines/mm in material (A) according to the present invention. For the method of measurement, see Ullmanns Enzyklopadie der technischen Chemie, 4th Edition, Volume 18, page 416.

EXAMPLE 2

Material (A) according to the present invention 360 ml of a coupler emulsion which has been prepared by the following method are added to 2000 g of a panchromatically sensitised silver bromide emulsion of relatively low speed containing 4% iodide.

10 g of the yellow coupler of formula 1 and 10 g of tricresylphosphate are dissolved in 50 ml of ethyl acetate and dispersed in a gelatine solution. The ethyl acetate is subsequently removed by evaporation.

The magenta coupler of formula 7 and the cyan coupler of formula 8 are emulsified in the same manner as described above. Both coupler emulsions are added in the quantities required to provide 30 g of each coupler. 60 ml of a 2% solution of the DIR compound of formula 4 are then added.

The low speed emulsion prepared as described above is cast on a transparent support. A second faster emulsion layer of high speed, which has been prepared by the following method, is applied to the resulting layer:

200 ml of a 2% aqueous solution of the yellow coupler of formula 6 are added to 1000 g of a panchromatically sensitised silver bromide emulsion of high speed having an iodide content of 6%. A emulsion of the magenta coupler of formula 7 which has been similarly emulsified is then added in the quantity required to provide 10 g of this coupler. The same procedure is adopted with the cyan coupler of formula 8. Lastly, 20 ml of a 1% aqueous solution of the DIR compound of formula 5 are added.

COMPARISION MATERIAL (B)

A light-sensitive emulsion containing coupler is cast on a transparent support. This emulsion has been prepared by the same method as described under (A), except that no DIR compound was added. A second, high speed emulsion layer prepared by the following method is added to the resulting layer.

200 ml of a 2% aqueous solution of the yellow coupler of formula 6 are added to 2000 g of a panchromatically sensitised silver bromide emulsion of high speed containing 6% iodide. 80 ml of a 5% solution of the magenta coupler of formula 2 and 70 ml of a 5% solution of the cyan coupler of formula 3 are then added.

Materials (A) and (B) are processed as described in Example 1. While the density curbes in yellow, magenta and cyan are otherwise equal, material (A) according to the present invention has a higher speed by 40% than material (B).

EXAMPLE 3

The material according to the present invention described in Example 2(A) is exposed imagewise and developed in a colour developer. For comparision, a high speed commercial black-and-white film based on silver halide and having a similar speed (400 ASA), but not containing colour couplers is exposed imagewise and developed in a black-and-white developer described as DK 60a in Glafkides, loc.cit. page 90. The two materials were developed to produce the same gradation. The graininess of the resulting films is shown in the Table below:

| | Graininess | | |
|---|---|---|---|
| At density: | 0.5 | 1.0 | 1.5 |
| Material (A)-invention | $2.1 \cdot 10^{-2}$ | $1.8 \cdot 10^{-2}$ | $1.6 \cdot 10^{-2}$ |
| Comparison | $2.3 \cdot 10^{-2}$ | $3.1 \cdot 10^{-2}$ | $3.6 \cdot 10^{-2}$ |

It is found, therefore, that substantially improved graininess is obtained using the material according to the present invention.

EXAMPLE 4

360 ml of a coupler emulsion which has been prepared by the following method are added to 2,000 g of a panchromatically sensitized slower silver bromide emulsion of relatively low speed containing 4% iodide:

8 g of a relatively slow coupling yellow coupler A and 2 g of a relatively rapidly coupling yellow coupler B and 10 g tricresylphosphate are dissolved in 50 ml of ethyl acetate and dispersed in a gelatine solution. The ethyl acetate is subsequently removed by evaporation.

The magenta coupler of formula 7 and the cyan coupler of formula 8 are emulsified in the same manner. These emulsions are added in such a quantity that 30 g of each coupler is present.

Finally 60 ml of a 2% solution of the DIR compound of formula 4 are added.

The obtained emulsion is cast on a transparent support. A second emulsion layer of relatively high speed which has been prepared by the following method, is then applied to the resulting layer:

60 g of the coupler emulsion of couplers A and B are added to 1,000 g of a panchromatically sensitized silver bromide emulsion. The coupler emulsion is prepared by dissolving 3,5 g of coupler B, 0,5 g of coupler A and 4 g tricresylphosphate in 20 ml of ethyl acetate. The mixture is then dispersed in a gelative solution. The ethyl acetate is subsequently removed by evaporation. Then an emulsion of magenta coupler of the formula 7 which has been emulsified correspondingly is added in such a quantity, that 4 g of the coupler are present. In the same manner the cyan coupler of the formula 8 is added. Finally 20 ml of a 1% aqueous solution of the DIR compound of formula 5 are added.

The effective reaction velocity constant of the yellow coupler A is about 1,000 and the effective reaction velocity constant of the yellow coupler B is about 6,000.

The obtained materials are exposed imagewise and processed as indicated in Example 1. Similar results are obtained.

EXAMPLE 5

A material is prepared as indicated in Example 4 with the alteration that 5 g of yellow coupler A and 5 g of yellow coupler B are added to the slower silver halide emulsion. Furthermore, 2 g of the yellow coupler A and 2 g of the yellow coupler B are added to the faster silver halide emulsion layer. After imagewise exposure and processing similar results are obtained as compared with the Example 4.

We claim:

1. Photographic recording material having at least two panchromatically sensitised silver halide emulsion layers differing in speed, the faster layer being further removed from the support than the slower layer, and each of these two layers containing at least two colour couplers at least one of which produces a yellow dye on chromogenic development, wherein at least one layer contains a compound capable of splitting off a development inhibitor, and whereby the faster silver halide emulsion layer contains a yellow coupler in a relatively rapidly coupling form and the slower layer contains a yellow coupler in a relatively slowly coupling form.

2. Material according to claim 1, wherein at least one panchromatically sensitised layer contains a magenta coupler and a cyan coupler.

3. Material according to claim 1, wherein at least one yellow coupler in the faster layer is hydrophilic and in a dissolved form and wherein at least one yellow coupler in the slower layer is hydrophobic and in an emulsified form.

4. Material according to claim 3, wherein the faster layer in addition contains at least one slowly coupling magenta coupler and one slowly coupling cyan coupler and wherein the slower layer also contains a magenta coupler and a cyan coupler.

5. Material according to claim 1, wherein the compound capable of releasing an inhibitor is contained in at least two panchromatically sensitised layers.

6. Material according to claim 5, wherein the inhibitor released is a mercapto compound.

7. Material according to claim 1, wherein a yellow coupler in a relatively slowly coupling form is contained in the faster silver halide emulsion layer and a yellow coupler in a relatively rapidly coupling form in the slower layer.

8. Process for the production of photographic images, wherein the material according to claim 1 is exposed imagewise and chromogenically developed.

9. Process according to claim 7, wherein the developer used is a compound of the p-phenylene diamine series.

* * * * *